US005197819A

United States Patent [19]

Hughes

[11] Patent Number: 5,197,819

[45] Date of Patent: Mar. 30, 1993

[54] MOUNTING BASE FOR HIGHWAY MARKERS

[75] Inventor: Robert K. Hughes, Fort Meyers, Fla.

[73] Assignee: Flexstake, Inc., Fort Meyers, Fla.

[21] Appl. No.: 744,384

[22] Filed: Aug. 31, 1991

[51] Int. Cl.[5] ..... E01F 9/01

[52] U.S. Cl. ..... 404/13; 403/83; 52/298; 40/612; 116/63 R

[58] Field of Search ..... 404/12-14; 52/298; 40/606, 607, 611, 612; 116/63 R, 63 P, 63 C, 63 T; 403/83

[56] References Cited

U.S. PATENT DOCUMENTS

| | | | |
|---|---|---|---|
| 997,053 | 7/1911 | Fritz | 52/298 |
| 2,775,221 | 12/1956 | Olson . | |
| 2,893,668 | 7/1959 | Applegate | 248/523 X |
| 3,250,032 | 5/1966 | Von Gal et al. | 40/606 |
| 3,368,518 | 2/1968 | Anthony | 116/63 |
| 3,779,493 | 12/1973 | Gildof | 248/523 X |
| 3,795,220 | 3/1974 | Hengesbach | 116/63 |
| 4,073,454 | 2/1978 | Sauber | 248/188.2 |
| 4,133,154 | 1/1979 | Ruzicka | 52/298 |
| 4,135,690 | 1/1979 | Clarke et al. | 248/188.2 |
| 4,269,534 | 5/1981 | Ryan | 404/10 |
| 4,364,688 | 12/1982 | Bitvai | 40/607 X |
| 4,522,530 | 6/1985 | Arthur | 404/10 |
| 4,793,111 | 12/1988 | Shewchuk | 52/298 |
| 4,870,440 | 9/1989 | Frost | 248/188.2 X |
| 4,926,592 | 5/1990 | Nehls | 40/607 X |

*Primary Examiner*—Ramon S. Britts
*Assistant Examiner*—Roger J. Schoeppel
*Attorney, Agent, or Firm*—James E. Bradley

[57] ABSTRACT

An improved apparatus for attaching a flexible marker shaft to a roadway. The flexible lower part of the marker shaft slides over a mandrel, and into a maker shaft cavity. Locking wedges are positioned in the cavity to surround and support the flexible marker support shaft in the cavity. A locking pin passes through a locking pin hole and locks the wedges and the marker shaft into the marker shaft cavity.

19 Claims, 2 Drawing Sheets

MOUNTING BASE FOR HIGHWAY MARKERS

BACKGROUND OF THE INVENTION

1. Field of the Invention:

This invention relates generally to apparatus mounting highway markers and signs to road surfaces, and more specifically to mounting flexible, replaceable shaft, markers and signs.

2. Description of the Prior Art:

Markers and signs are widely used on streets and highways for various purposes: to indicate the edge of the road, to direct and control traffic flow, to warn of road hazards and to provide information by indicating direction or location. Frequently these markers are positioned where they may be accidently struck by a passing vehicle.

When struck by a vehicle, most marker shafts break or become permanently deformed at the point they are attached to a mounting base. Since the mounting base usually survives the vehicle impact, only the marker and/or marker shaft requires replacement. And preferably the mounting base design permits replacement without the time, equipment and expense of detaching the mounting base from the road surface.

Recently, marker posts with flexible elements have been disclosed. In U.S. Pat. No. 5,826,823 by Hughes, a flexible element is used near the bottom end of the marker shaft to help prevent damage caused by impact. The flexible element allows the marker shaft to bend from an upright position, to a position parallel to the roadway, and to snap back to the upright position, without sustaining damage. The '823 patent teaches the mounting of the flexible element to a post anchored in the ground adjacent to the roadway.

In many instances it is desirable to attach the mounting base to the roadway without damaging the road surface by digging an anchoring post hole. The '823 patent does not disclose a base for mounting to a roadway.

The highway marker disclosed in U.S. Pat. No. 4,269,534 by Ryan permits replacement of the marker shaft without detaching the mounting base from the road surface. However, the base of Ryan is not designed to support the flexible portion of a marker shaft assembly as shown in Hughes.

SUMMARY OF THE INVENTION

The present invention is an improved apparatus for attaching the flexible element of a flexible marker shaft to the roadway, without causing damage to the roadway. The apparatus also provides means to efficiently replace the marker shaft without detaching the mounting base from the roadway.

The present invention has a base plate with a bottom surface suitable for attaching to a road surface by using small bolts or adhesive. The top surface has a marker shaft cavity extending from the top surface into the base plate. In the center of the cavity, there is an upward protruding mandrel that is solidly joined to the base plate. An opening in the flexible lower part of the marker shaft slides over the mandrel, and into the marker shaft cavity. Locking wedges are positioned in the cavity between the marker shaft cavity walls and the marker support shaft, thereby surrounding and supporting the marker support shaft in the cavity. A locking pin hole, transverse to the marker support shaft, extends through the base plate, into the marker shaft cavity, through the locking wedges, through the flexible marker shaft, and into the mandrel. A locking pin passes through the locking pin hole and locks the wedges and the marker shaft into the marker shaft cavity.

DETAILED DESCRIPTION OF THE INVENTION

Figure 1:
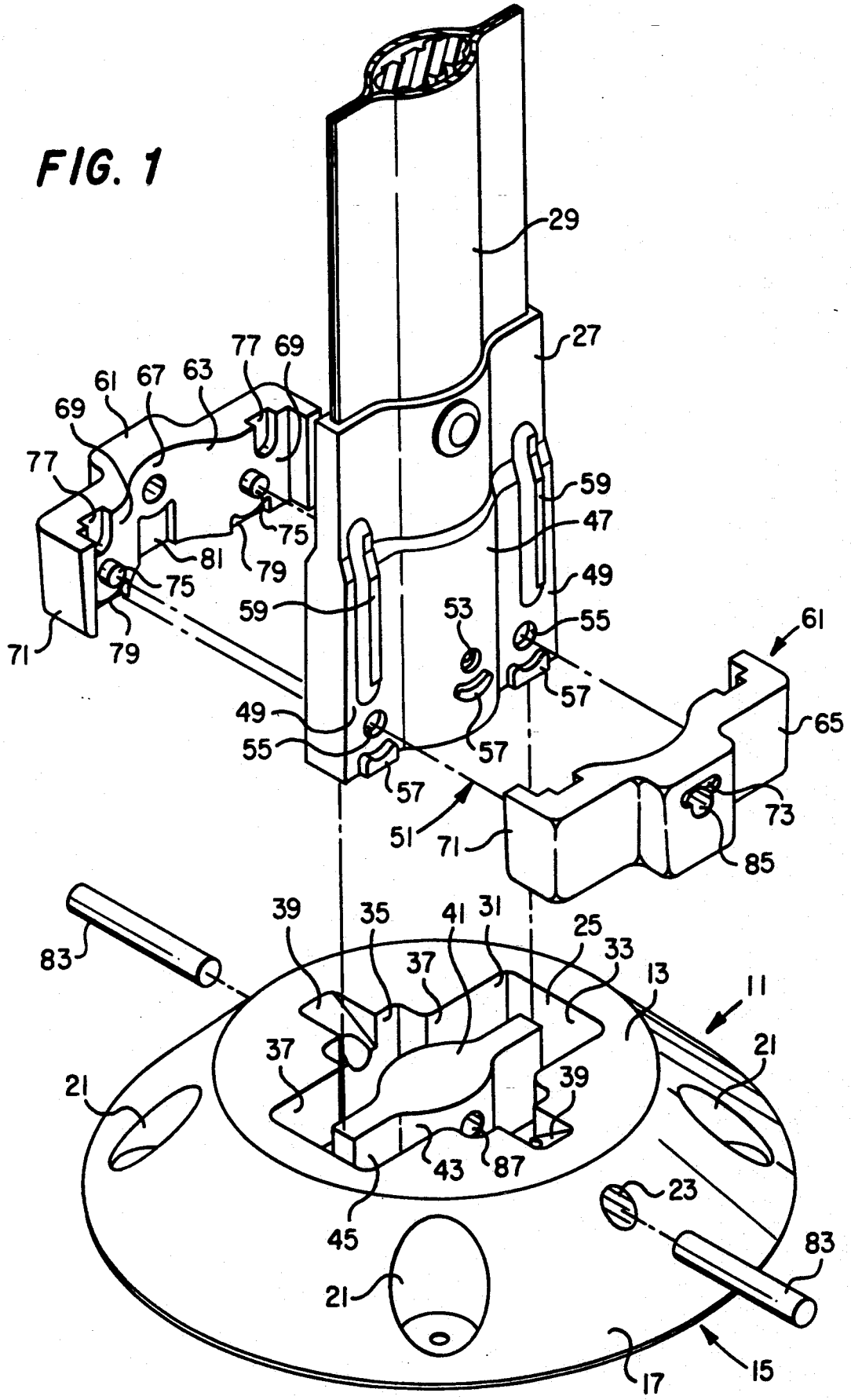
FIG. 1 is an exploded perspective view of a mounting base for highway markers constructed in accordance with the invention.
Figure 2:
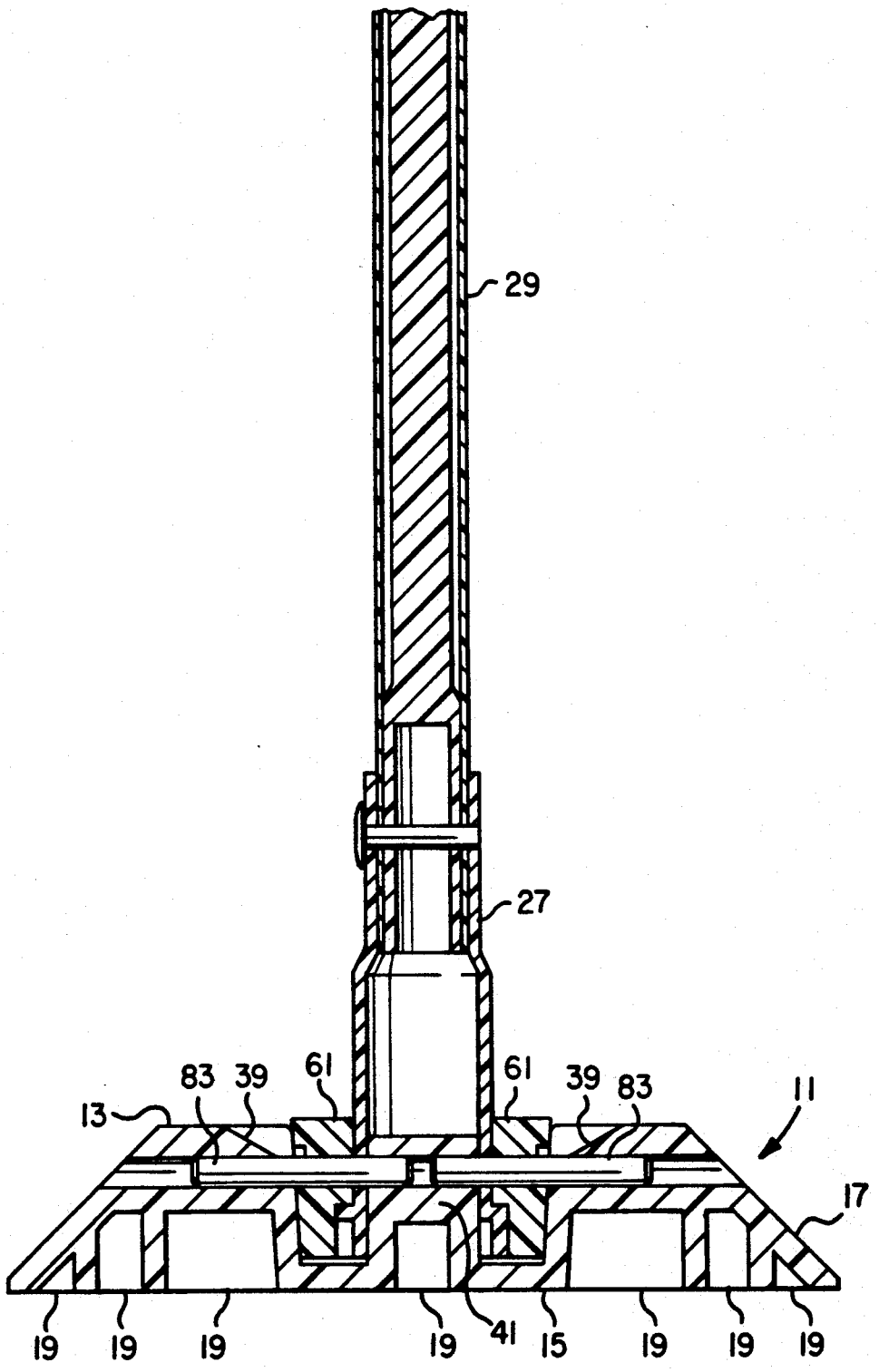
FIG. 2 is a vertical section view of the mounting base of FIG. 1.

Referring to FIG. 1, base plate 11 has a top surface 13 and a bottom surface 15. Base 11 has a circular periphery and an axis that is vertical. A conical sidewall 17 joins the bottom surface 15 to the top surface 13. The bottom surface 15 is suitable for attachment to the roadway either by use of an adhesive or by use of bolts. In order to increase the surface area for adhesive bonding, bottom surface 15 is contoured to receive adhesive. In the present embodiment, the contour shape is provided by adhesive cavities 19, shown in FIG. 2. Sockets 21 allow bolting of the base 11 to the roadway. A pair of locking pin holes 23 pass radially through the center of the base plate 11. Locking pin holes 23 are co-axial and have entrances in the sidewall 17.

A marker shaft cavity 25 is located in the center of the top surface 13, and is shaped to receive a flexible element 27, which is attached to and forms the lower end of the marker shaft 29. Cavity 25 has a substantially rectangular perimeter, with sidewalls 31 and end walls 33. End walls 33 are parallel with the axis of the locking pin holes 23, and are substantially vertically parallel to the sidewalls 31. Both end walls 33 and sidewalls 31 taper at a slight angle relative to the vertical axis of the base 11. Sidewalls 31 each have a central portion 35 that is laterally set back from the side portions 37. Ramps 39 extend from top surface 13 downward into each sidewall 31. Ramps 39 are located above the locking pin holes 23.

Base plate 11 also has a upward protruding mandrel 41 located in marker shaft cavity 25. Mandrel 41 has a central portion 43 and two opposing side portions 45. The central portion 43 is generally elliptical in cross section. The side portions 45 are thinner, and generally flat and located in a common plane with each other and the axis of the central portion 43. Mandrel 41 is solid, rigid and integrally joined with base 11. The locking pin hole 87 also passes through the center of mandrel 41, and perpendicular to the plane of the side portions 45. A clearance exists between the mandrel 41 and the sidewalls 31 and end walls 33.

The flexible element 27 has a central portion 47 and two coplanar, opposed, side portions 49, which closely resemble the shape of the mandrel 41. The front side of flexible element 27, shown in FIG. 1, and the back side, not shown, are substantially the same. The lower end of flexible element 27 has an outer perimeter and an opening 51 that closely resembles the shape of mandrel 41, allowing bottom of flexible element 27 to slide over, and conform to, the shape of mandrel 41. The central portion of opening 51 is generally elliptical. The side portions of opening 51 are generally rectangular. The lower part of the flexible element 27 has a locking pin hole 53 that will be coaxial with locking pin holes 23. Holes 55 pass entirely through the lower part of side portions 49 and opening 51. Lugs 57 are substantially rectangular and slightly curved upward in a "U" shape. Lugs 57 are located on both sides of flexible element 27 below holes 55 and 53. Ribs 59 run longitudinally along both sides of side portions 49 to add strength.

A pair of locking wedges 61 fit into the marker shaft cavity 25 between walls 31 and 33 of the marker shaft cavity 25, and the flexible element 27. Each locking wedge 61 is made of rigid material and has an inner surface 63 that contours to the exterior of the flexible element 27, and an outer surface 65 that contours to cavity sidewall portions 35 and 37, and faces toward conical sidewall 17. The inner surface 63 has a concave center portion 67 that contours the central portion 47 of flexible element 27, and side portions 69 that contour to side portions 49 of flexible element 27. The outer surface 65 of wedge 61 is tapered so that the dimension across the top of wedge 61 is greater than the dimension across the bottom. The taper of the outer surface 65 matches the taper of cavity walls 31 and 33. The wedges 61 have end portions 71 that abut each other and match the contour of the cavity end walls 33. Screwdriver slot 73 is substantially rectangular and is located on the outer surface 65 above the center of hole 85 and above the level where ramp 39 intersects sidewall 35. Screwdriver slot 73 is the same width as ramp 39 and is aligned with ramp 39.

The locking wedges 61 also have engaging pins 75, located on the inner side portions 69, for engaging the holes 55 of the flexible element 27. Slots 77 are also located on side portions 69, and are aligned with and conform to ribs 59. Recesses 81 and 79 align with and conform to lugs 57.

In operation, base 11 will be secured to the roadway such as by adhesive in cavities 19. To assemble the unit, the locking wedges 61 are placed around the outside of flexible element 27, aligning engaging pins 75 and holes 55, and lugs 57 and recesses 79 and 81. This assembly is pressed into cavity 25. As the assembly of the locking wedges 61 and the flexible element 27 is pressed into the marker shaft cavity 25, the tapered outer surface 65 causes wedges 61 to compress the flexible element 27 against the mandrel 41, thereby securely gripping the flexible element 27.

After pressing the assembly into marker shaft cavity 25, the locking pins 83 are inserted into holes 23, 85, 53, and 87, thereby locking the flexible element 27 and the wedges 61 into the cavity 25.

To replace the flexible element 27, first the locking pins 83 are removed. Next, the tip of a screwdriver is placed in screwdriver slot 73, and ramp 39 is used as a fulcrum to pry the locking wedges 61 from the marker shaft cavity 25. Now the flexible element 27 may be replaced, and the unit reassembled as described above.

The invention has significant advantages. The compressing action of the locking-wedge design is a good method of spreading forces evenly across the flexible element 27. This design also compensates for manufacturing tolerance accumulation errors which can cause problems in assembling parts. The self compensating design makes the parts cheaper to build and assemble.

While the invention has been shown in only one of its forms, it should be apparent to those skilled in the art that it is not so limited, but is susceptible to various changes without departing from the scope of the invention.

I claim:

1. A mounting base for supporting a marker support shaft of a highway marker comprising in conjunction:

a base plate having a top surface and a bottom surface, the bottom surface suitable for attaching the base plate to a road surface;

a marker shaft cavity extending from the top surface and having a plurality of cavity walls;

an upward protruding mandrel joined to the base plate and located within the marker shaft cavity, the exterior of the mandrel defining a clearance between the mandrel and the marker shaft cavity wall, the clearance being of suitable shape as to receive the marker support shaft, the marker support shaft having a lower end with a receptacle which slides over the mandrel and locates in the cavity;

a locking pin hole extending through the base plate, into the marker shaft cavity, and into the mandrel, the lower end of the marker support shaft having a locking pin hole that registers with the locking pin hole of the base and mandrel; and a locking pin passing through the locking pin holes of the base, lower end of the marker support shaft, and the mandrel, for locking the marker support shaft to the base plate.

2. The mounting base according to claim 1 wherein at least a portion of the marker shaft cavity wall tapers as the cavity extends into the base plate, such that the distance across the cavity becomes smaller as the cavity extends into the base.

3. The mounting base according to claim 1 wherein the marker shaft cavity is generally rectangular and has two sidewalls, and two end walls of shorter dimension than the sidewalls.

4. The mounting base according to claim 1 wherein the marker shaft cavity walls are tapered so that the distance across the cavity becomes smaller as the cavity extends into the base.

5. The mounting base according to claim 1 wherein the locking pin is substantially perpendicular to the side walls.

6. The mounting base according to claim 1 wherein the mounting base has screwdriver ramps extending from the top surface downward into the cavity to aid in disassembly.

7. The mounting base according to claim 1 wherein the mandrel has a generally elliptical center portion, and flat side portions; and wherein the receptacle of the lower end of the marker support shaft has a mating elliptical center portion and flat side portions.

8. A highway marker comprising in combination:

a base plate having a top surface and a bottom surface, the bottom surface suitable for attaching the base plate to a road surface;

a marker shaft cavity extending from the top surface and having a plurality of cavity walls;

an integrally formed upward protruding mandrel joined to the base plate and located within the marker shaft cavity, the exterior of the mandrel defining a clearance between the mandrel and the marker shaft cavity wall, the clearance being a suitable shape as to receive the marker support shaft, the marker support shaft having a lower end which slides over the mandrel and locates in the cavity;

a marker support shaft having a lower end that extends into the cavity, the lower end having a locking pin hole in the marker shaft, for locking the marker support shaft to the base plate;

at least one locking wedge positioned in the cavity between the marker shaft cavity walls and the marker support shaft, the locking wedge surrounding and supporting the marker support shaft in the cavity;

a locking pin hole extending through the base plate transverse to the marker support shaft, into the marker shaft cavity, through the locking wedge, and through the mandrel;

a locking pin passing through the locking pin hole in the base plate, locking wedges, into the locking pin hole in the marker shaft, and through the mandrel, for locking the marker support shaft to the base plate.

9. A highway marker according to claim 8 wherein at least one of the marker shaft cavity walls tapers so that the distance across the cavity becomes smaller as the cavity extends into the base plate.

10. A highway marker according to claim 8 wherein each of the locking wedges and the lower end of the marker support shaft have interlocking lugs and recesses.

11. A highway marker according to claim 8 wherein two of the locking wedges are positioned in the cavity between the marker shaft cavity walls and the marker support shaft, the locking wedges surrounding and supporting the marker support shaft in the cavity.

12. The highway marker according to claim 11 wherein each of the locking wedges has an inside surface that contacts the marker support shaft, and an outside surface that contacts the support shaft cavity wall, the inside surface having a concave portion that matches a contour of the marker support shaft, and the outside surface having a tapered surface to provide strength.

13. A highway marker comprising in combination;

a base plate having a top surface and a bottom surface, the bottom surface suitable for attaching the base plate to a road surface;

a marker shaft cavity extending from the top surface and having a plurality of cavity walls;

an upward protruding mandrel joined to the base plate and located within the marker shaft cavity, the exterior of the mandrel defining a clearance between the mandrel and the marker shaft cavity wall, the clearance being of suitable shape as to receive the marker support shaft, the marker support shaft having a lower end which slides over the mandrel and locates in the cavity;

a marker support shaft having a lower end that extends into the cavity, the lower end having a locking pin hole in the marker shaft, for locking the marker support shaft to the base plate;

at least one locking wedge positioned in the cavity between the marker shaft cavity walls and the marker support shaft, the locking wedge surrounding and supporting the marker support shaft in the cavity;

a locking pin hole extending through the base plate transverse to the marker support shaft, into the marker shaft cavity, through the locking wedge, and through the mandrel;

a locking pin passing through the locking pin hole in the base plate, locking wedges, into the locking pin hole in the marker shaft, and through the mandrel, for locking the marker support shaft to the base plate.

14. The mounting base according to claim 13 wherein the marker shaft cavity walls taper so that the distance across the cavity becomes smaller as the cavity extends into the base plate.

15. The mounting base according to claim 13 wherein the marker shaft cavity is generally rectangular and has two sidewalls, and two end walls of shorter dimension than the sidewalls.

16. The mounting base according to claim 15 wherein the sidewalls and end walls of the marker shaft cavity are tapered so that the distance across the cavity becomes smaller as the cavity extends into the base.

17. The mounting base according to claim 16 wherein the locking pin is substantially perpendicular to the sidewalls.

18. The mounting base according to claim 13 wherein the mounting base has screwdriver ramps extending from the top surface downward into the cavity to aid in disassembly.

19. The mounting base according to claim 13 wherein the mandrel has a generally elliptical center portion, and flat side portions.

* * * * *